US009855737B2

(12) United States Patent
Williams

(10) Patent No.: US 9,855,737 B2
(45) Date of Patent: Jan. 2, 2018

(54) NANOCOMPOSITE-INK FACTORY

(71) Applicant: Vadient Optics, LLC., Beaverton, OR (US)

(72) Inventor: George Williams, Portland, OR (US)

(73) Assignee: Vadient Optics, LLC, Beaverton, OR (US)

( * ) Notice: Subject to any disclaimer, the term of this patent is extended or adjusted under 35 U.S.C. 154(b) by 354 days.

(21) Appl. No.: 14/480,515

(22) Filed: Sep. 8, 2014

(65) Prior Publication Data

US 2016/0067659 A1 Mar. 10, 2016

(51) Int. Cl.

| | |
|---|---|
| ***B01F 5/06*** | (2006.01) |
| ***B41F 31/00*** | (2006.01) |
| ***B01F 11/02*** | (2006.01) |
| ***B01F 13/10*** | (2006.01) |
| ***B41F 31/02*** | (2006.01) |
| *B01F 3/12* | (2006.01) |

(52) U.S. Cl.

CPC ..... *B41F 31/00* (2013.01); *B01F 5/0661* (2013.01); *B01F 11/02* (2013.01); *B01F 13/1063* (2013.01); *B41F 31/02* (2013.01); *B01F 2003/125* (2013.01); *B01F 2215/0059* (2013.01)

(58) Field of Classification Search

CPC ..... B01F 11/02; B01F 5/0661
USPC ..... 366/127, 142, 152.1, 154.1, 155.1
See application file for complete search history.

(56) References Cited

U.S. PATENT DOCUMENTS

| | | | | |
|---|---|---|---|---|
| 4,403,866 | A * | 9/1983 | Falcoff | B01F 13/1055 366/132 |
| 5,192,130 | A * | 3/1993 | Endo | B01F 3/0811 366/155.1 |
| 2007/0281099 | A1 | 12/2007 | Howarth et al. | |
| 2008/0062811 | A1* | 3/2008 | Janssen | B01F 5/0618 366/127 |
| 2009/0181177 | A1 | 7/2009 | Li et al. | |
| 2011/0048171 | A1 | 3/2011 | Enright et al. | |
| 2015/0023643 | A1 | 1/2015 | Chartoff et al. | |

* cited by examiner

*Primary Examiner* — David Sorkin

(57) ABSTRACT

An apparatus for manufacturing nanocomposite-ink, the apparatus comprising, a nanoparticle reservoir, an organic-matrix reservoir, a homogenizer, and a dispenser. The homogenizer combines the nanoparticles and the organic-matrix, dispersing the nanoparticles within the organic-matrix, thereby producing a nanocomposite-ink for dispensement by the dispenser.

27 Claims, 3 Drawing Sheets

NANOCOMPOSITE-INK FACTORY

TECHNICAL FIELD OF THE DISCLOSURE

The present disclosure relates in general to 3-dimensional inkjet printers. The disclosure relates in particular to production of nanocomposite-ink for printer deposition.

DISCUSSION OF BACKGROUND ART

Generally inkjet printers require replaceable cartridges. The cartridges, which contain the printable material in a reservoir are installed on a printhead, inside the printer, which dispense the printable material. Some industrial printers have large ink-reservoirs that can be refilled, otherwise when the cartridge runs out of material, the cartridge must be replaced with a new cartridge and the old is either thrown away or recycled for future use. This application relates to another approach.

SUMMARY OF THE DISCLOSURE

The present disclosure is directed to an apparatus for producing nanocomposite-ink. In one aspect, the apparatus in accordance with the present disclosure comprises of a continuous flow reactor, a reservoir, a dispensing nozzle, and a homogenizer. The continuous flow reactor producing nanoparticles. The reservoir holding an organic-matrix. The homogenizer combining the nanoparticles and the organic-matrix, dispersing the nanoparticles within the organic-matrix.

BRIEF DESCRIPTION OF THE DRAWINGS

The accompanying drawings, which are incorporated in and constitute a part of the specification, schematically illustrate preferred embodiments of the present disclosure, and together with the general description given above and the detailed description of preferred methods and embodiments, given below, serve to explain principles of the present disclosure.

DETAILED DESCRIPTION OF THE DISCLOSURE

Figure 1:
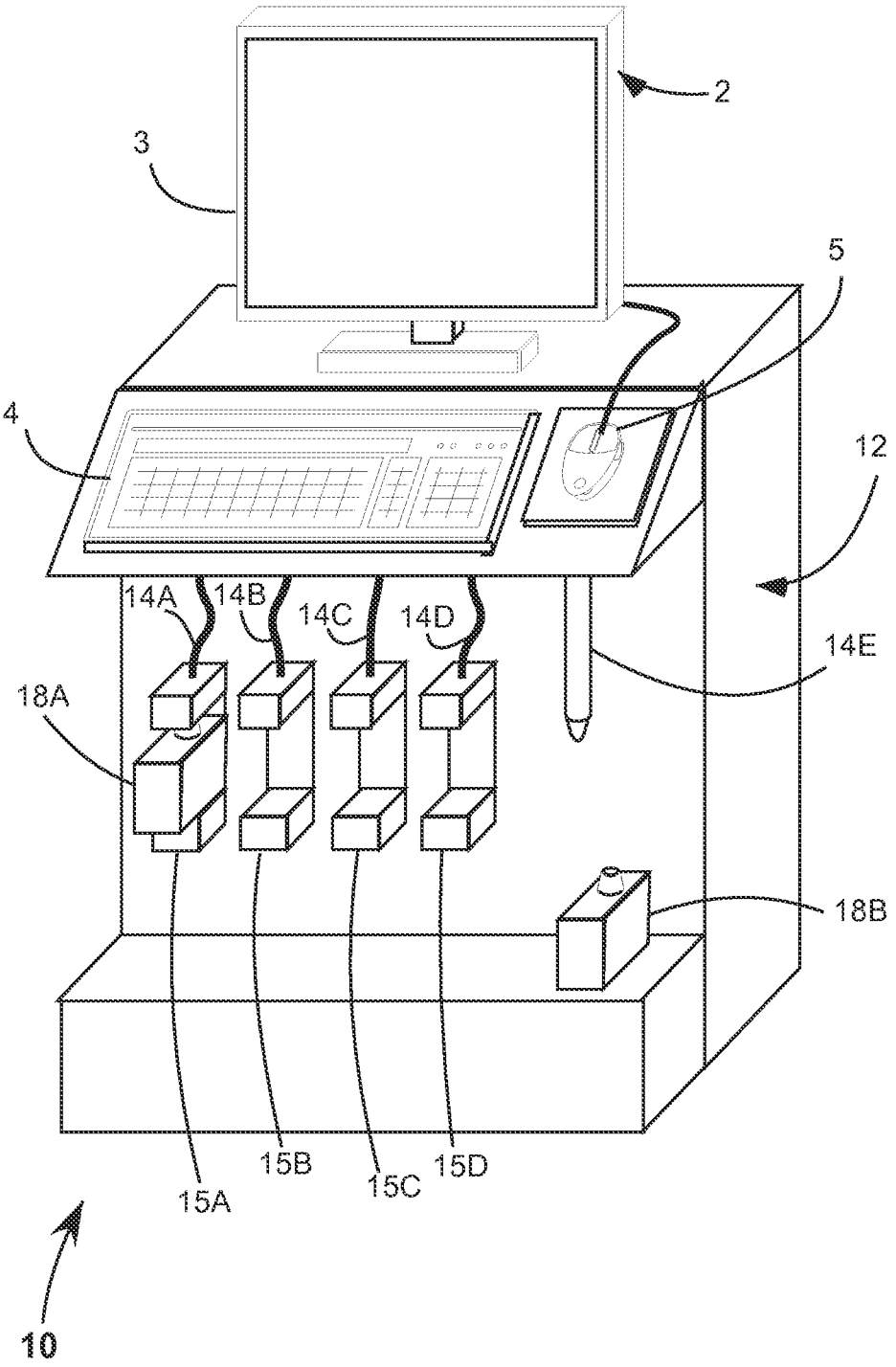
FIG. 1 is a perspective-view, schematically illustrating an apparatus for manufacturing nanocomposite-ink in accordance with the present disclosure, the apparatus comprising a nanoparticle reservoir, an organic-matrix reservoir, a homogenizer; and a dispenser, wherein the homogenizer combines the nanoparticles and the organic-matrix, dispersing the nanoparticles within the organic-matrix thereby producing a nanocomposite-ink for dispensement by the dispenser.

Referring now to the drawings, wherein like components are designated by like reference numerals. Methods of manufacture and preferred embodiments of the present disclosure are described further herein below.

FIG. 1 is a perspective view illustrating an apparatus 10 to manufacture a nanocomposite-ink in accordance with the present disclosure. Generally a nanocomposite-ink is used for printing articles with an inkjet printer. Apparatus 10 comprises of a nanoparticle reservoir, an organic-matrix reservoir, a homogenizer, and a dispenser. The homogenizer combines the nanoparticles and the organic-matrix, dispersing the nanoparticles within the organic-matrix to produce the nanocomposite-ink within an apparatus body 12, the process described in detail further hereinbelow. Apparatus 10 produces nanocomposite-ink based on user input to a computer 2. Here, the computer is shown integrated with a monitor 3, a keyboard 4, and a mouse 5, although any controls either physically integrated or remotely located can be used. The computer preferably has an optimization algorithm that takes into account numerous factors, described further hereinbelow, synchronizing the production of the nanocomposite-ink based on the nanocomposite-ink required for a predetermined nanocomposite-ink or a recipe for an article to be printed with the nanocomposite-ink.

After homogenization, the nanocomposite-ink is delivered to a dispenser 15A, 15B, 15C, and 15D via a feedline 14A, 14B, 14C, and 14D, respectively. Here, the feedlines are flexible and ultraviolet opaque. The feedlines can be made out of plastic with inner diameters in the millimeter scale or smaller. The feedlines can be capillary, sized with sufficient inner diameter to allow the nanocomposite-ink to flow, capillary sizes are preferable when the nanocomposite-ink supplied to the inkjet printer in the feedline changes characteristics, as will be described further hereinbelow. Here, a four dispenser 15A, 15B, 15C, and 15D interface with inkjet cartridges for fill or refill and a dispenser 14E allows for refill into bulk containers or reservoirs. An exemplary inkjet cartridge 18B is shown resting on a shelf and an exemplary inkjet cartridge 18A installed in dispenser 14A, dispenser 14A designed to interface with inkjet cartridge 18A.

Figure 2:
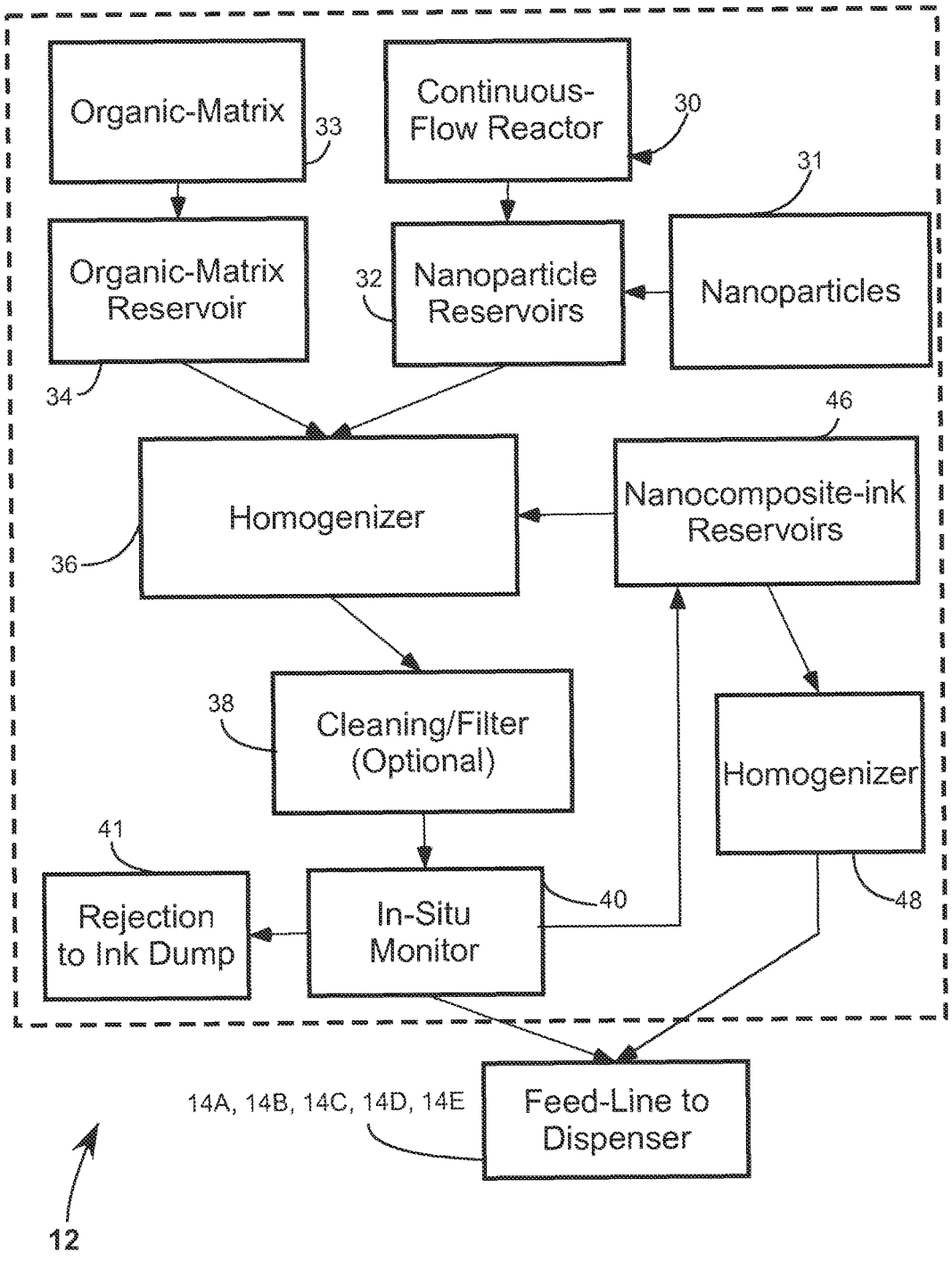
FIG. 2 is a block diagram illustrating the operation of the nanocomposite-ink factory and production of nanocomposite-ink.

FIG. 2 is a block diagram operationally illustrating nanocomposite-ink factory 12. Nanocomposite-ink factory 12 has a nanoparticle reservoir 32 and a organic-matrix reservoir 34. The organic-matrix reservoir can store a bulk organic-matrix material 33. Nanoparticle reservoir 32 can store bulk a nanoparticles 31 loaded into the nanocomposite-ink factory or the nanocomposite-ink factory can have integrated nanoparticle production. A continuous flow reactor can be integrated to produce the nanoparticles. Here, a continuous flow reactor 30 produces the nanoparticles to be held in reservoir 32, explained in further detail below. While only a single nanoparticle reservoir and a single organic-matrix reservoir are shown, the nanocomposite-ink factory can have multiple reservoirs of each. The materials can be manually fed or alternatively, the organic-host material, nanoparticles, or any other chemicals required for manufacture of nanocomposite-ink can be delivered via a pump. Nanoparticles from reservoir 32 and organic-matrix material from a reservoir 34 combine in a homogenizer 36.

The organic-matrix can be any ink-jet printable material. For optical application the organic-matrix material is preferable is ink-jet printable, optically clear, photo-curable resins and monomers. Non-limiting examples of printable organic-matrix material for are cyanoethyl pullulan (CYELP), polyacrylate, hexanediol diacrylate (HDODA), polymethyl methacrylate (PMMA), diethylene glycol diacrylate (DEGDA), Neopentyl glycol diacrylate, tricyclodecane dimethanol diacrylate (TCDDMDA), urea, cellulose, and epoxy resins such as the SU-8 series resists. For optical applications, the nanoparticles are preferably sized sufficiently small with respect to light wavelengths, for those wavelengths intended for use, not to scatter the light.

The nanocomposite-inks can be different by the nanoparticle size, the nanoparticle type, the organic-host matrix type, or concentration of the nanofillers and combinations thereof. The nanoparticles can be oxides, fluorides, semiconductors, ceramics, or metals. Non-limiting examples of nanofillers include beryllium oxide (BeO), aluminum nitride (AlN), silicon carbide (SiC), zinc oxide (ZnO), zinc sulfide (ZnS), zirconium oxide (ZrO), yttrium orthovanadate ($YVO_4$), titanium oxide ($TiO_2$), copper sulfide ($CuS_2$), cadmium selenide (CdSe), lead sulfide (PbS), molybdenum disulfide ($MoS_2$), Tellurium dioxide ($TeO_2$) and silicon dioxide ($SiO_2$) including those with core, hollow core, core-shell, and core-shell-ligand architectures. The refractive-index of the nanocomposite-ink can be modified by the organic-matrix and nanoparticles composition. The nanocomposite-ink can be tuned by the organic-matrix type, the nanofiller type, and the concentration of the nanofillers in the organic-matrix. The refractive-index of a nanocomposite-ink will be the summation by percent volume of the optical properties of the organic-matrix, or organic-host, and the nanofillers. Concentration by volume of the nanoparticles to the organic-host can be about 0.25% to about 70% volume, depending on desired properties. Various examples of nanoparticle and organic-matrix combinations and chemistries is described in PCT Pat. Application No. US 2014/036660, assigned to the assignee of the present disclosure and the complete disclosure of which is hereby incorporated by reference in its entirety.

Homogenizer 36 mixes the nanoparticles and organic-matrix material such that the nanoparticles are substantially dispersed in the organic-matrix, thereby creating the nanocomposite-ink. Any method or feature which introduces turbulence can help homogenize the nanocomposite-ink. Specific homogenization methods include using static members, shear mixing, or sonification. Static members include plate-type mixers, T-mixers, helical mixers, grids, blades and combinations thereof. For instance the nanoparticles and organic-matrix can be pneumatically pumped through a cylinder pipe section with the static mixing members incorporated within the cylinder, the members cause turbulence as the nanocomposite-ink pass by them, thereby mixing the nanoparticles and the organic-matrix. Such static mixing solutions and design guides for mixing applications are available at Stamixco, LLC., located in the Brooklyn, N.Y., of the United States. Shear mixing can be performed by active movement of mixing member or by high shear mixing. High shear mixers are available at Ross High Shear Mixers located in Hauppauge, N.Y. of the United States. Further, the homogenizer can be, or above methods assisted by, ultrasonic vibration, with in-line solutions available at Sonic & Materials, Inc. located in Newtown, Conn. of the United States. Last, all the above homogenized techniques can be temperature controlled to allow chemical reaction, if appropriate, control vibrational energy, and temperature dependent liquid viscosity.

After homogenization the nanocomposite can, optionally, be passed through a filter 38 to eliminate any agglomerated nanoparticles or otherwise pass through a cleaning process. Cleaning processes, include filtering, bubble removal, chemical cleaning, or evaporation of by-product. For example, if during homogenization any aeration occurred a bubble trap can be implemented to remove bubbles. If chemical by-product or solvent needs to be removed or neutralized, chemicals can be added or evaporative methods can be used. For instance, the nanocomposite-ink can be passed through gas air flow, heating, and low pressure zones in a laminar flow or a cylindrical fluid sheath to maximize surface area.

During and after production, the nanocomposite-ink can, optionally, be monitored by an in-situ optical monitor 40. The in-situ optical monitor can be either camera based or a flow-cell type. The camera based monitor can image the nanocomposite-ink as it is being produced to monitor and capture gross defects in the nanocomposite-ink. Examples of such defects that are desirable to monitor with the camera based optical monitor include aeration, coloration, or large agglomeration of nanoparticles. The flow-cell type optical monitor uses a scattering technique in which light impinges on the flow-cell as the nanocomposite-ink is passes through the flow cell. A photodetector captures the forward scattered light passing through the flow-cell. If large particles or agglomeration of particles occur, then the light will scatter at other angles and the photodetector signal will drop, indicating a defect. More advanced flow-cell methods can additionally capture side scatter and allow for more precise determination of nanoparticle size or agglomeration size. Monochromatic light passing through the cell, can be detected to determine the transmissive, reflective, or absorbing properties of the inks. Broadband light with a dispersive element before the detecting element can be used determine the spectral properties of the inks. Similarly, optical stimulations can be used for Raman Spectroscopy, Spectral Luminescence, Pump-probe spectroscopy or other analytical technique that can be used to characterize the properties of the ink and its components. The optical monitor can implement electro-magnetic transmitters as the light source. The transmitter electro-optical spectrum can be gamma-ray, x-ray, ultraviolet, visible, near-infrared, thermal infrared, or microwave. Further, implementation of an angled or prism shaped flow-cell allows determination of the refractive index of the nanocomposite-ink by measuring the angle of the exiting refracted beam. The nanocomposite-ink that is undesirable can be rejected into ink-dump 41 or otherwise the desirable nanocomposite-ink pass via feedline 14A, 14B, 14C, 14D or 14E to the appropriate dispensers or stored in a nanocomposite-ink reservoir 46. Additionally, the optical monitor and the various types of optical monitoring can be implemented at any point along the process and provide feedback.

The nanocomposite-inks that are stored in the nanocomposite-ink reservoirs 46 can be fed to the printhead as desired via connection to one of the feedlines 14A, 14B, 14C, or 14D. Additionally if any mixtures of the nanocomposite-inks are desired, then they can be sent into homogenizer 48 for mixture and delivery to the dispensers. Further the nanocomposite-ink in one of the reservoirs can be used in production of more of the nanocomposite-ink. For instance it can be sent to the homogenizer 36 in place of the organic-matrix material, or in addition to it. While the nanocomposite-ink factory is especially well suited for production of the nanocomposite-ink, it can also have reservoirs for traditional 3-dimensional printing materials and composites.

Figure 3:
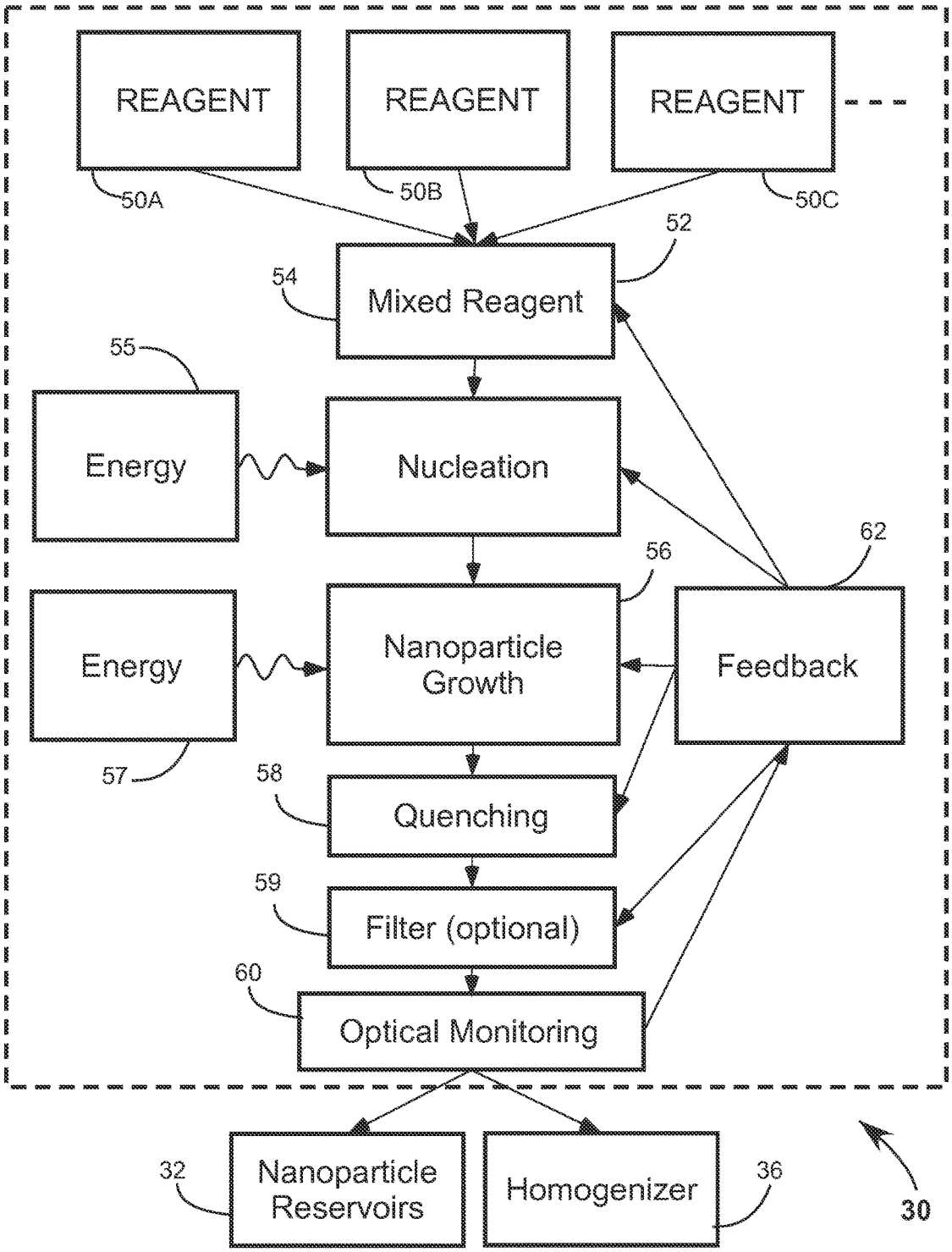
FIG. 3 is a block diagram, illustrating the operation of a continuous flow reactor which can be incorporated within the nanocomposite-ink factory.

FIG. 3 is a block diagram describing operation of continuous flow reactor 30. Continuous flow reactor 30 can provide on-demand custom nanoparticle production. Continuous flow reactor 30 has a reagent reservoir 50A, 50B and 50C which contain precursors, additives, solvents and ionic liquids necessary for production of nanoparticles. While only three are shown, the continuous flow reactor can have as many reagent reservoirs as required nanoparticle production. The necessary reagents used to produce nanoparticles and accompanying chemistry supplies can be found at Sigma-Aldrich in St. Louis Mo. of the United States. Each of the reagent reservoirs are heat controlled maintained at pre-set temperatures. The reagent are mixed in a mixed reagent zone 52 such that a Reynolds number range from about 150 to about 300 is achieved to ensure quality mixing within a reasonable volume. Any mixing or homogenizing technique can be used dependent on the necessary flow rate. For instance standard static T-mixer is sufficient for flow rates up to 100 mL/min, such as low pressure T-mixer part number P-714, available at IDEX Health and Science in Oak Harbor, Wash. of the United States. Increased flow can be obtained by utilizing parallel channels or different mixing techniques as previously described in the homogenization process. To transport the mixed reagents through the tubing of the Continuous flow reactor "plug flow" is a preferably method. "Plug flow" transport allows inert gas buffer "plugs" of the mixed reactant such that the reactant is segmented by the inert gas during transport. The "plug" self-mixes via friction with the tube walls.

Mixed reagent 52 enters a nucleation zone 54 in which a energy source 55 is uniformly applied to heat the mixed reagent and decompose the injected precursors and initiate nucleation reaction forming the nanoparticles. The heat can be generated in a variety of ways such as convective heat (such as liquid metal, oil and water baths), radiant-heat, microwave, laser, or conductive heating (such as joule heating, chemical reaction, combustion, or nuclear decay). Further photocatalysts can be added to enhance nucleation. Preferably the mixed reagent experiences a rapid temperature ramp such that the heat energy rapidly decomposes precursors and any barrier to nucleation thereby allowing a high rate of nucleation. When it is desirable to have a uniform nanoparticle size distribution it is important that the temperature be sufficiently short in duration to prevent nanocrystal growth after the initial nucleation. This ramping process ensures nanoparticles are the same size when a uniform size distribution is desired.

The nucleated particles, or the nanoparticles, are transported to a nanoparticle growth zone 56. The nanoparticles are heated by an energy source 57 at constant temperature, lower than that required for nucleation. The heating allow the nanoparticles to grow in a controlled manner. Convective heat (such as liquid metal, oil and water baths), radiant-heat, microwave, laser, or conductive heating (such as joule heating, chemical reaction and combustion, or nuclear decay) can be used to heat the nanoparticles. The rate at which the nanoparticles are pumped through the system, the temperature of the system, and the heat transfer to the nanoparticles determine the rate of growth. After appropriate growth to the desired nanoparticle size the nanoparticle are quenched to stop growth.

At a quenching zone 58 the growth of the nanoparticles is terminated by reduction in temperature. If needed, solvents are added for chemical quenching thereby stopping any additional chemical reactions and to create the nanoparticle dispersion. A filter 59 is an optional purification stage to remove any non-reacted regents, secondary reaction products or solvents. The Filter 59 can incorporate decanting, in-line centrifuge, membrane filters, and solvent evaporators as well as temperature control. An optical monitor 60, which is preferably a flow-cell optical monitor, as described above, measures the nanoparticle characteristic and based on those characteristics provides a feedback 62 for process control. The nanoparticle dispersion is then either held in the appropriate nanoparticle reservoir 32 or sent directly to homogenizer 36 for production of the nanocomposite-ink.

The continuous flow reactor in the printing apparatus may be a macro system with traditional tube flow design, use a microreactor, or combination of both. Traditional flow design allows for larger scale nanoparticle production. The microreactors use microfluidic channels with less output capacity but with modular design. The inside diameter of the microfluidic channel can be between about 10 microns to about 10,000 microns. Multiple microfluidic channels, each with a microreactor, can be implemented in order to increased output of nanoparticles. For applications which require multiple nanoparticle sizes or types to be produced simultaneously, multiple continuous flow reactors, of either, or combinations of the two designs can be used.

The aforementioned computer must control and take into account the aforementioned variables and characteristics to appropriately produce and supply the nanocomposite-ink. For instance, a predetermined recipe may be available, a user may input the particular properties required of the nanocomposite-ink, or the computer will take into account the particular requirement of the article to be printed. For instance, a positive GRIN lens, can have either a predetermined recipe or the optimizer can generate a recipe based on characteristics such as focal length, diameter or shape, spectral properties, and the required performance of the aforementioned characteristics. Generation of the recipe and the nanocomposite-ink will depend on the types of nanoparticles, organic-host, and nanocomposite-ink currently available in the respective reservoirs. Further, the type of nanocomposite-ink produced will depend on the refractive-gradient requirements and whether the gradient in any particular area will be formed primarily by diffusion, and intermixing of different concentrations of nanocomposite-ink upon deposition, as described in references further hereinbelow, or by production of intermediate nanocomposite-inks.

For the continuous flow reactor, the computer must take into account the type of reagents utilized, the rate of chemical reactions, the temperature, and the flow through any tubing. The flow through the system in any particular area will in turn depend on viscosity, the diameter of the tube or apparatus, the temperature, and the material. The flow can be calculated, or preferably measured with an in-line flow meter. The computer will also take into account the nucleation temperature, the ramp cycle of the nucleation, the temperature during growth, the flow rate through the nanoparticle growth cycle, and then control and optimize the continuous flow reactor operation based on feedback from the in-situ optical monitoring. Likewise, during the factories homogenization process, the computer will control the amount of time spent in homogenization based on feedback from the optical-monitoring.

The computer can also control the nanocomposite-ink that will be rejected. For instance, the nanocomposite-ink can intermix when traveling through the feed-lines. When the nanoparticles characteristic requirement changes, such as nanoparticle type or concentration for a new cartridge, the feedline will transition between the nanocomposite-inks, which may intermix. With larger inner diameters, more intermixing will result. While preferably the recipe generated is optimized to use the intermixed nanocomposite-ink, if the intermixed nanocomposite-ink is unusable in the generated recipe, the computer will direct the inkjet printer to deposit the unusable nanocomposite-ink in the ink-dump and can flush the feedlines.

The printing apparatus and various embodiments described above has a variety of useful applications. In general, the printing apparatus can be used to print nanocomposite 3-dimensional objects. It is especially suited well for printing graded index refractive optics, optical system, and subsystems. For instance, the nanocomposite-ink can be chosen and structured to create an optical-element that compensates chromatic aberration or increase chromatic dispersion, see U.S. patent application Ser. No. 14/278,164, assigned to the assignee of the present disclosure and the complete disclosure of which is hereby incorporated by reference in its entirety. Further, electro-optic nanofillers can be utilized in the optical-device and implemented to manufacture electro-optic modulators, see U.S. patent application Ser. No. 14/278,164, assigned to the assignee of the present disclosure and the complete disclosure of which is hereby incorporated by reference in its entirety. Similarly, optically nonlinear (NLO) nanofillers can be utilized in the optical-device and implemented to achieve optically nonlinear effects for applications which require optical limiting, see U.S. patent application Ser. No. 14/293,574, assigned to the assignee of the present disclosure and the complete disclosure of which is hereby incorporated by reference in its entirety. For printing Fresnel type gradient optics, see U.S. patent application Ser. No. 14/299,777 and for printing optical-elements with integrated conductive paths, see U.S. patent application Ser. No. 14/307,071, both assigned to the assignee of the present disclosure and the complete disclosures of which is hereby incorporated by reference in its entirety.

From the description of the present disclosure provided herein one skilled in the art can construct the disclosed apparatus in accordance with the present disclosure. Those skilled in the art to which the present disclosure pertains will recognize that while above-described embodiments of the inventive printing apparatus and method of manufacture are exemplified using particular configurations, others may be used without departing from the spirit and scope of the present disclosure.

In summary, the present invention is described above in terms of particular embodiments. The invention, however, is not limited to the embodiments described and depicted herein. Rather, the invention is limited only by the claims appended hereto.

What is claimed is:

1. An apparatus for manufacturing nanocomposite-ink, the apparatus comprising:

a nanoparticle reservoir;

a nanoparticle continuous flow reactor with a first energy source for nanoparticle nucleation and a second energy source for nanoparticle growth;

an organic-matrix reservoir;

a homogenizer that disperses the nanoparticles within the organic matrix; and a dispenser, wherein the homogenizer combines the nanoparticles and the organic-matrix, dispersing the nanoparticles within the organic-matrix thereby producing a nanocomposite-ink for dispensement by the dispenser.

2. The apparatus of claim 1, further comprising an optical monitor.

3. The apparatus of claim 1, further comprising an ink dump.

4. The apparatus of claim 1, wherein the dispenser has an interfaces that is compatible with an inkjet cartridge.

5. The apparatus of claim 1, wherein the apparatus has a plurality of organic-host reservoirs.

6. The apparatus of claim 1, wherein the apparatus has a plurality of nanoparticle reservoirs.

7. The apparatus of claim 1, wherein the homogenizer has a sonifier.

8. The apparatus of claim 1, wherein the homogenizer has static mixing members.

9. The apparatus of claim 1, wherein the homogenizer has active mixing members.

10. The apparatus of claim 1, wherein the homogenizer has high shear mixers.

11. The apparatus of claim 1, wherein the apparatus further comprises of plurality of nanocomposite-ink reservoirs, each of the plurality of nanocomposite-ink reservoirs storing the nanocomposite-ink.

12. The apparatus of claim 11, wherein the plurality of nanocomposite-ink reservoirs have an agitator to keep the nanoparticles dispersed in the organic-matrix.

13. The apparatus of claim 1, further comprising a computer that controls the apparatus operation.

14. The apparatus of claim 13, further comprising an optical monitor, wherein the optical monitor and the computer are in communication and data from the optical monitor is used to change one or more of the inputs to the reactor.

15. The apparatus of claim 14, wherein the optical monitor is positioned to measure nanoparticle size.

16. The apparatus of claim 14, wherein the optical monitor is positioned at the dispenser to measures the chemical composition of the nanocomposite-ink.

17. The apparatus of claim 14, wherein the optical monitor is positioned at the nanoparticle reservoir to measures the crystallinity of the nanoparticles.

18. The apparatus of claim 14, wherein the optical monitor is a spectrometer.

19. The apparatus of claim 18, wherein the optical monitor is positioned at the dispenser to measures spectral absorption of the nanocomposite-ink.

20. The apparatus of claim 13, wherein the optical monitor includes an electro-magnetic transmitter.

21. The apparatus of claim 1, wherein the first energy sources or the second energy source is an electro-magnetic source.

22. The apparatus of claim 1, wherein the second energy sources is a fluidic bath.

23. The apparatus of claim 1, further comprising a pumping mechanism to inject one or more chemicals into the apparatus.

24. The apparatus of claim 1, wherein the continuous flow reactor manufactures nanoparticles sized below 70 nm.

25. The apparatus of claim 1 wherein the inside diameter of a channel within the apparatus measures between about 10 microns to about 10,000 microns.

26. The apparatus of claim 25, wherein a photoactive catalyst is disposed within the one or more of the channels.

27. The apparatus of claim 1, wherein the nanoparticles are from the group consisting of semiconductors, metal oxides, metal nitrides, metal chalcogenides, fluorides, sulphides, graphene, graphite, ceramics, and metals.

* * * * *